US007167128B1

(12) United States Patent
Akturan

(10) Patent No.: US 7,167,128 B1
(45) Date of Patent: Jan. 23, 2007

(54) MODULAR PATCH ANTENNA PROVIDING ANTENNA GAIN DIRECTION SELECTION CAPABILITY

(75) Inventor: Riza Akturan, Edgewater, NJ (US)

(73) Assignee: Sirius Satellite Radio, Inc., New York, NY (US)

( * ) Notice: Subject to any disclaimer, the term of this patent is extended or adjusted under 35 U.S.C. 154(b) by 0 days.

(21) Appl. No.: 10/678,463

(22) Filed: Oct. 3, 2003

(51) Int. Cl.
*H01Q 1/38* (2006.01)

(52) U.S. Cl. ..... 343/700 MS

(58) Field of Classification Search ..... 343/700 MS, 343/846, 873

See application file for complete search history.

(56) References Cited

U.S. PATENT DOCUMENTS 5,438,697 A * 8/1995 Fowler et al. ..... 455/347
5,977,710 A * 11/1999 Kuramoto et al. ... 343/700 MS
6,731,243 B1 * 5/2004 Taira et al. ..... 343/700 MS
6,765,534 B1 * 7/2004 Kwon et al. ..... 343/700 MS

* cited by examiner

*Primary Examiner*—Michael C. Wimer
(74) *Attorney, Agent, or Firm*—Patrick F. Bright

(57) ABSTRACT

A modular patch antenna includes a first module and a second module. The first module comprises a first metal or metal plated radiating layer, a second, middle dielectric layer, and a third metal or metal plated ground layer; the second module comprises a frame that attaches to or fits onto the periphery of the first module and comprises a dielectric layer, or the same three layers as the first module. The first module provides favorable satellite signal reception. By superimposing the second module around the first module, the antenna provides improved terrestrial signal reception. This capability could apply to Satellite Digital Audio Radio Systems systems. This provides capability of changing the antenna gain beam direction towards the desired signals at a user's location. Users of such systems can perform this function manually.

18 Claims, 6 Drawing Sheets

MODULAR PATCH ANTENNA PROVIDING ANTENNA GAIN DIRECTION SELECTION CAPABILITY

This invention relates to modular patch antennas. These antennas are especially adapted for use in receiving audio information and data from both terrestrial and satellite transmitters.

These modular patch antennas are especially adapted for use in receiving both satellite-transmitted and terrestrially-transmitted digital audio/data radio services. The following patents and patent applications related to these systems are hereby incorporated by reference as though fully set forth here:

| U.S. Pat. No. | Title | Issue Date |
|---|---|---|
| 6,564,053 | Efficient High Latitude Service Area Satellite Mobile Broadcasting Systems | May 13, 2003 |
| 6,023,616 | Satellite Broadcast Receiver System | Feb. 8, 2000 |
| 5,864,579 | Digital Radio Satellite And Terrestrial Ubiquitous Broadcasting System Using Spread Spectrum Modulation | Jan. 26, 1999 |
| 5,794,138 | Satellite Broadcast System Receiver | Aug. 11, 1998 |
| 5,592,471 | Mobile Radio Receivers Using Time Diversity To Avoid Service Outages In Multichannel Broadcast Transmission Systems | Jan. 7, 1997 |
| 5,485,485 | Radio Frequency Broadcasting Systems And Methods Using Two Low-Cost Geosynchronus Satellites And Hemispherical Coverage Antennas | Jan. 16, 1996 |
| 5,319,673 | Radio Frequency Broadcasting Systems And Methods Using Two Low-Cost Geosynchronus Satellites | Jun. 7, 1994 |

| EPO Patent | Title | Date Of Pub. |
|---|---|---|
| EP 0 959 573 A2 EP 990303823 | System For Efficiently Broadcasting Via Satellite To Mobile Receivers In Service Areas At High Latitude | Nov. 24, 1999 |

| Int'l. Pub. No. | Title | Intl. Pub. Date |
|---|---|---|
| WO 01/33729 A1 | Method And System For Providing Geographic Specific Services In A Satellite Communications Network | 10 May 2001 |
| WO 01/33720 A3 | Method And Apparatus For Selectively Operating Satellites In Tundra Orbits To Reduce Receiver Buffering Requirements For Time Diversity Signals | 10 May 2001 |

Satellite Digital Audio Radio Services (SDARS), such as those provided by Sirius Satellite Radio Inc. and XM Satellite Radio, Inc, are examples of a wireless content delivery system implementation that uses both satellite and terrestrial transmitters to deliver audio and data content to users located at various parts of a service area. In such systems, the receiver usually works with satellite signals in rural areas, and, where terrestrial sites exist, with terrestrial signals in urban areas. Generally, satellites are visible to receiver antennas when the satellites are at or above about 20° elevation angle in the sky. The terrestrial networks are visible to receiver antennas at or about below 10° elevation angle in the horizontal direction.

The SDARS systems provide various broadcast content (i.e. audio and data) delivery services over a large system service area, e.g. CONUS (the mainland United States). Signal delivery is made to subscribing receivers within a system service area from geo-stationary or geo-synchronous satellite networks, simultaneously with a ground-based terrestrial signal delivery network. Service delivery performance enhancement of these broadcast signals using selectable-beam antenna operation capability is an object of this invention.

This invention relates to methods and systems that comprise modular patch antennas that improve the operational performance of the Satellite-based Direct Audio Radio Services (SDARS) (e.g. Sirius Satellite Radio) by user modification of such systems. These patch antennas preferably comprise first and second modules. The first module comprises a first metal or metal plated radiating layer, a second, or middle, dielectric layer, and a third metal or metal plated ground layer.

This invention also relates to methods and systems for enabling selectable receiver antenna beam patterns that provide selectable operational performance to receivers that are for use with both satellite and ground-based terrestrial networks.

Although the invention could apply to a wide range of frequencies, preferred embodiments of SDARS antennas receive signals with frequencies in a range of about 2320 MHz to about 2345 MHz. For SDARS applications, the radiating layer comprises, in preferred embodiments, metal or metal plating such as Ag, Au, Cu, Ni, or Al. Preferably, this layer of metal or plating has a length in the range of about 30 to about 60 mm, and a width in the range of about 30 to about 60 mm.

The dielectric layer, in preferred embodiments, comprises substances that can have different dielectric constants, such as Teflon, PTFE (polytetrafluoroethylene), glass, ceramic, aluminum, polymers, silica, or quartz. This layer preferably has a height or thickness in the range of about 1 to about 5 mm, and a perimeter in the range of about 35 to about 65 mm.

The ground layer, in preferred embodiments, comprises a metal or metal plating such as Ag, Au, Cu, Ni, or Al. This layer of metal or plating has a width in the range of about 35 to about 65 mm, and a length in the range of about 35 to about 65 mm.

In some embodiments, the perimeter of each of the three layers is substantially the same, and is in the range of about 30 to about 60 mm. Preferably, the antenna is square, rectangular, round or elliptical in shape.

A second modular component comprises a frame that attaches to/fits onto the periphery of the first module. This frame preferably has a length and a width in the range of about 40 to about 75 mm, a height or thickness in the range of about 1 to about 5 mm, and preferably comprises the same material as the dielectric layer of the first module, but can comprise a different dielectric material, if desired. Alternatively, the second module may be a frame that comprises the same three layers as the first module, and, preferably, has all three layers of substantially the same size and shape as the three layers of the first module.

The first module of the modular patch antenna, in preferred embodiments, has a circularly polarized gain at elevation angles of about 40° or more in the sky, in the range of about +5 to about +6 dBic, and a vertically polarized gain, at 0° elevation angle, in the range of about −6 to about −7 dBi. To receive terrestrially transmitted SDARS signals, the patch antenna preferably has a vertically polarized gain, at 0° elevation angles, of at least about −5 dBic in circular polarization, which translates to about −2 dBi in vertical polarization, assuming that the left and right hand polarization components have the same magnitude.

For the patch antenna to receive satellite SDARS signals, the circularly polarized gain of the antenna is preferably about +3 dBic at a minimum. Preferably, the increase in the dielectric frame size increases the circularly polarized gain of the antenna at 0° to about −5 dBic from about −8 dBic, where the antenna patch has a periphery in the range of about 50 to about 175 mm, thus increasing the vertically polarized gain of the antenna at 0° elevation angle by about 3 dB.

BRIEF DESCRIPTION OF THE DRAWINGS

This invention can be better understood by reference to the accompanying drawings, in which.

DETAILED DESCRIPTION OF THE PREFERRED EMBODIMENTS

Figure 1:
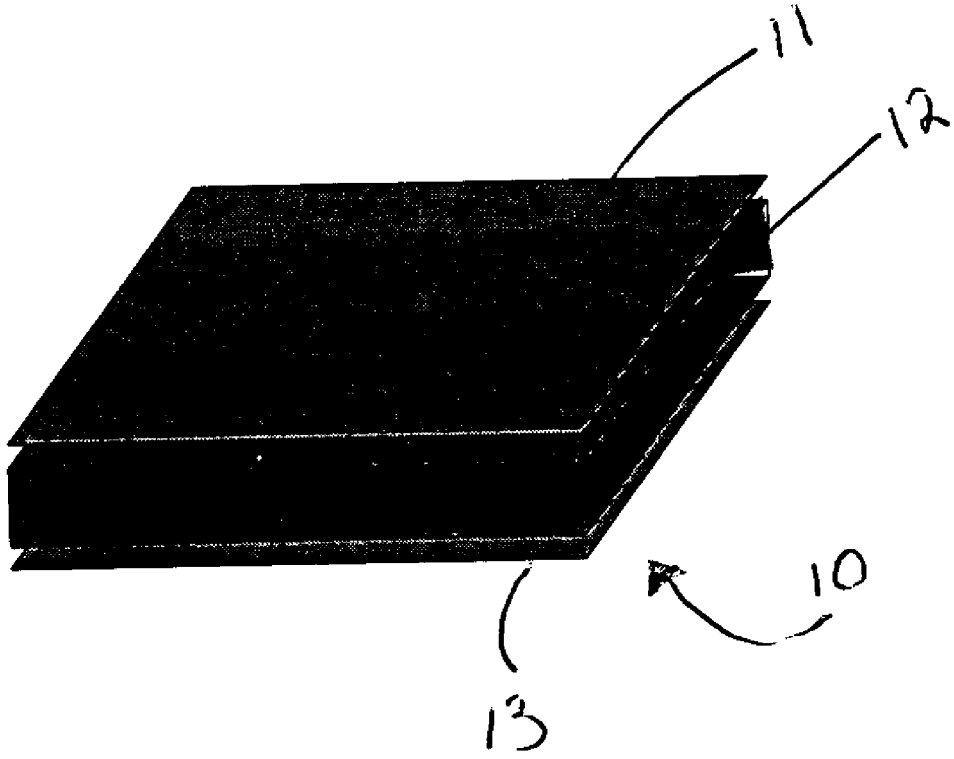
FIG. 1 shows an embodiment of a first module of a modular patch antenna, optimized for reception of satellite radio transmission.
Figure 2:
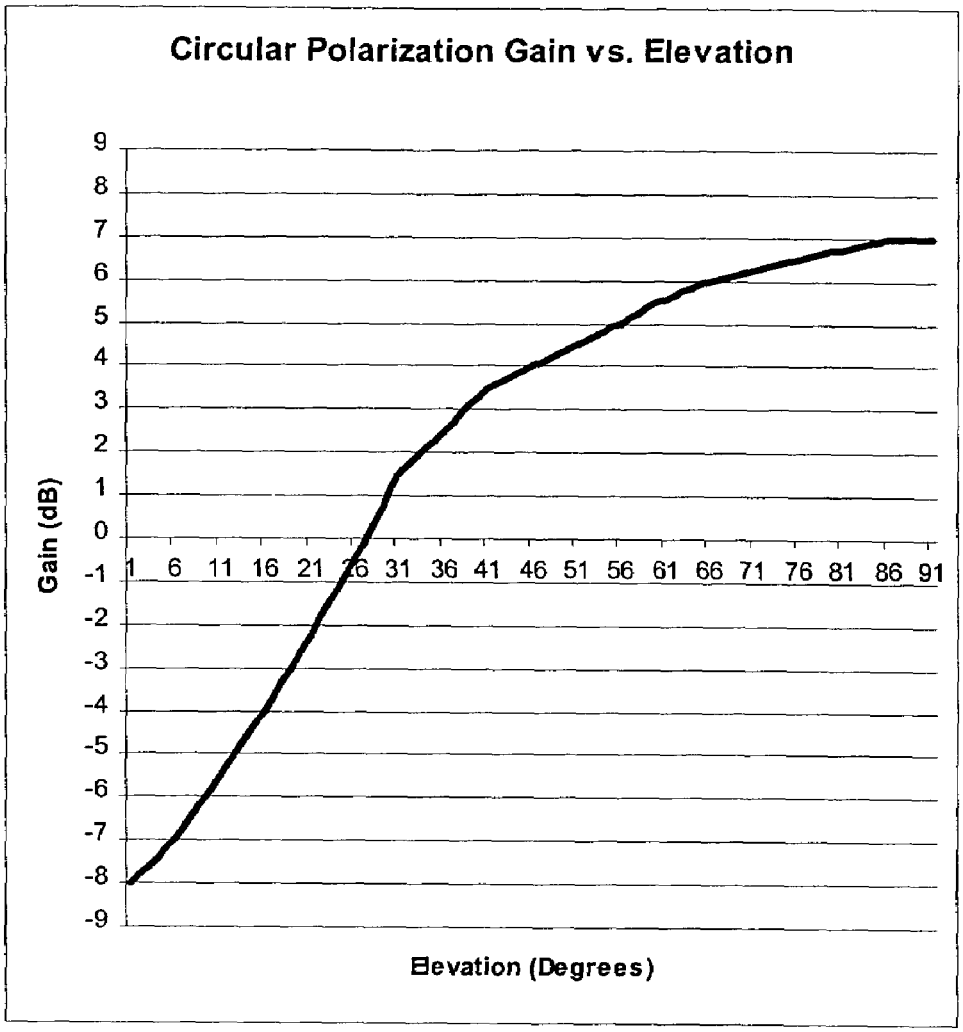
FIG. 2 shows the circular polarization gain pattern of the patch antenna module of FIG. 1.

FIG. 1 shows a first patch antenna module 10 comprising a first metal radiating layer 11, a middle dielectric layer 12, and a third ground plane layer 13. Preferably, module 10 is 42 cm long, 42 cm wide and 17 cm thick FIG. 2 shows the measured gain pattern of the antenna module of FIG. 1. This antenna provides a left-hand circularly polarized gain (LHCP) of up to 7 dBic LHCP at around 90° elevation. This gain level is favorable for reception of signals from SDARS satellites that are at high elevations, e.g. 50° and above.

FIG. 2 also shows that the antenna module of FIG. 1 provides a left-hand circular polarized gain of about −8 dBic at 0° elevation angle at the horizontal direction. Terrestrial signals are vertically linear polarized. At low elevations, this module's vertically linear polarized signal reception gain is 3 dB higher than its left-hand circularly polarized signal reception gain pattern. This is because both the left-hand and the right-hand polarized gain patterns are at equal levels, producing a 3 dB higher vertical gain of −5 dBi vertical polarization (VP) gain at low elevations. Normally, 0 dBi VP gain is expected for normal terrestrial signal reception. Thus, the level achieved with the module of FIG. 1 is 5 dB below the acceptable level for terrestrial reception.

Terrestrial signal pickup requires the antenna beam to concentrate at low elevation angles. To obtain better terrestrial signal reception from the antenna of FIG. 1, extending the patch dielectric size yields an increase at 0° elevation angle in the horizontal direction.

Figure 3:
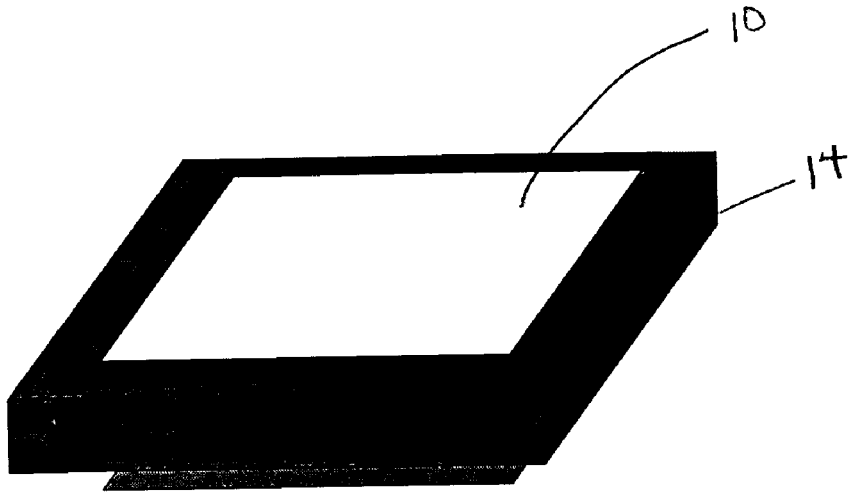
FIG. 3 shows the patch antenna of FIG. 1 combined with a second module, namely a frame that extends the size of the dielectric layer of first module, thus optimizing the antenna for reception of terrestrial radio transmission.

FIG. 3 shows the module 10 of FIG. 1 combined with a second module 14, an extended dielectric layer forming a frame around the first module. The perimeter of the dielectric, and of the two-module antenna, is 50 mm by 50 mm. The antenna's circularly polarized gain at 0° increases to −5 dBic, as compared to −8 dBic for the first module of FIG. 1 alone.

Figure 4:
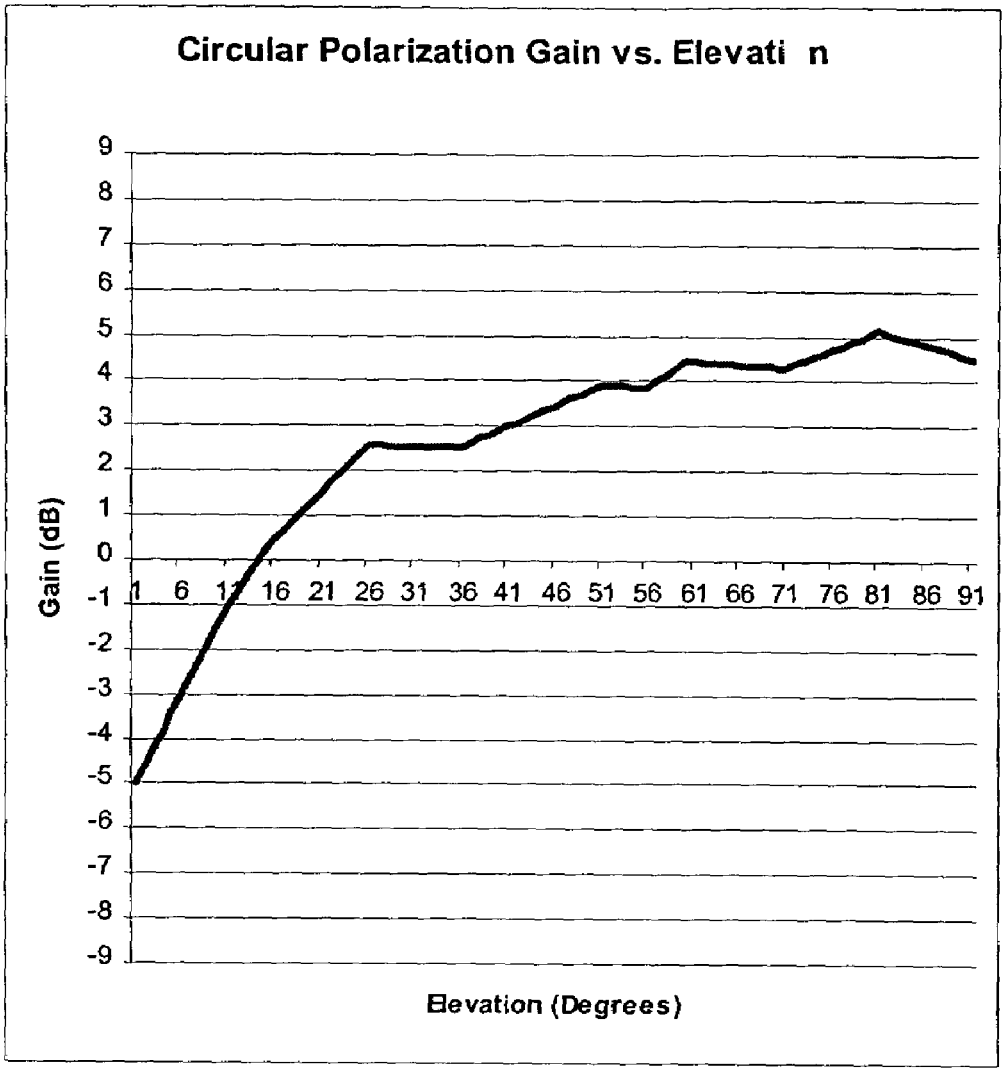
FIGS. 4 and 5 show the measured circular polarization gain pattern of the modular patch antenna of FIG. 3.

FIG. 4 shows that the antenna of FIG. 3 has a −5 dBic LHCP or −2 dBic vertically polarized gain at 0° elevation angle at the horizontal direction, enhancing the terrestrial signal reception by 3 dB. However, this antenna sacrifices the high gain needs of satellite signal reception at high elevations at the vertical direction by about 2 dB.

Figure 5:
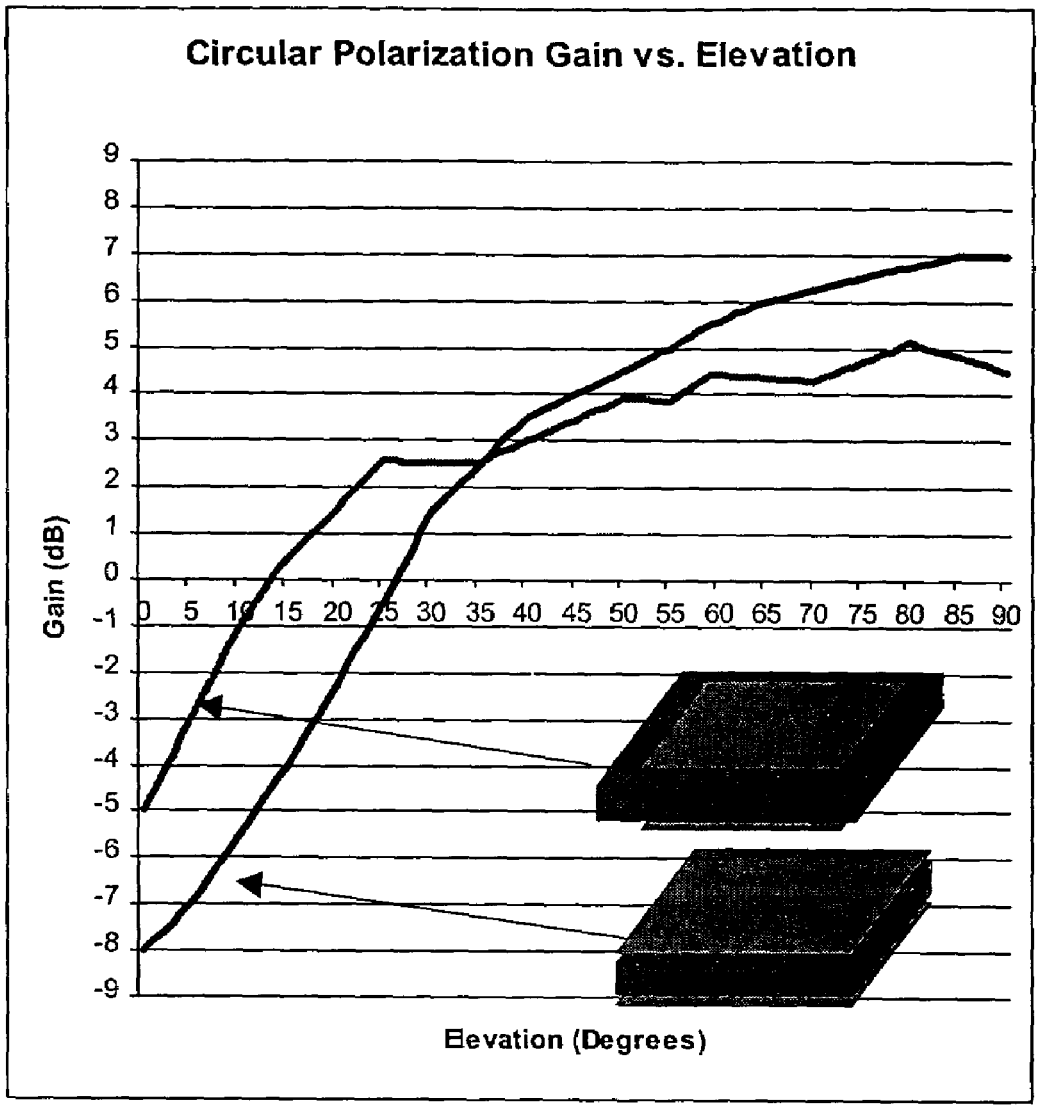

FIG. 5 plots the gain curves shown in FIG. 2 and FIG. 4 on the same graph. The antenna of FIG. 3 has 2 dB less gain at the satellite signal reception direction at about a 90° elevation angle.

Figure 6:
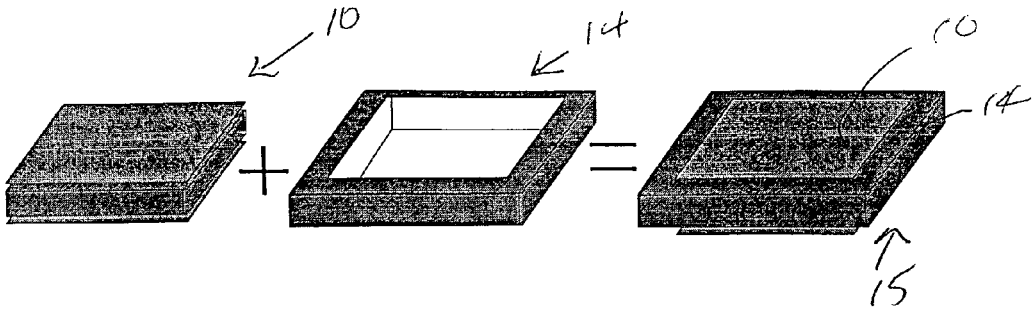
FIG. 6 shows a first embodiment of an assembly of the first and second patch antenna modules.

As FIG. 6 shows, a second module can be added to the first module manually or otherwise. The first module alone provides good satellite signal reception. The first and second modules together, as FIG. 6 shows, provide good terrestrial SDARS signal reception.

Figure 7:
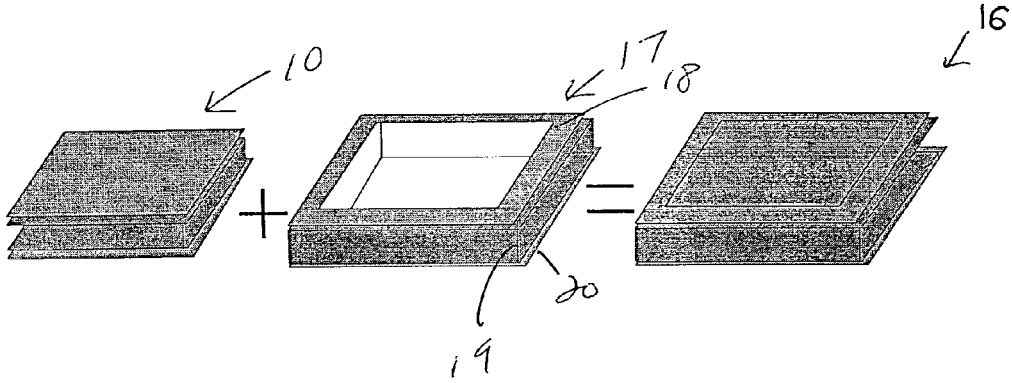
FIG. 7 shows a second embodiment of a two-module modular patch antenna.

As FIG. 7 shows, a second embodiment of a modular antenna 15 comprises a first module, as shown in FIG. 6, and a second module that is a frame. This frame comprises the same three layers as the first module, namely a first metal radiating layer 18, a second or middle dielectric layer 19, and a third metal ground layer 20. By contrast, the patch antenna embodiment of FIG. 6 consists solely of the dielectric material of the middle layer in the first module.

The invention claimed is:

1. A modular patch antenna system comprising a first module and a second module, said first module comprising a first metal or metal-plated radiating layer, a second, middle dielectric layer, and a third metal or metal-plated ground layer, said second module comprising a frame that attaches to or fits onto the periphery of the first module, said frame comprising: a first metal or metal plated radiating layer, a second middle dielectric layer, and a third metal or metal plated ground layer, wherein the first metal or metal plated radiating layer in the second module lies in substantially the same plane as the first metal or metal plated radiating layer in the first module, the second middle dielectric layer of the second module lies in substantially the same plane as the second middle dielectric layer of the first module, and the third metal or metal plated ground layer in the second module lies in substantially the same plane as the third metal or metal plated ground layer in said first module, and said frame has an inner periphery substantially the same as the outer periphery of said first module.

2. The antenna of claim 1, wherein all three layers of said second module have substantially the same height as the corresponding layers of said first module.

3. The antenna of claim 1, wherein said first module has a circularly polarized gain, at elevation angles of about 40° or more in the sky, in the range of about +5 to about +6 dBic, providing favorable satellite signal reception performance.

4. The antenna of claim 1 wherein said first and second modules are attached to one another, and said antenna has a circularly polarized gain at 0° elevation angle of at least about −2 dBic, providing favorable terrestrial signal reception performance.

5. The antenna of claim 1 linked to a receiver adapted to receive radio broadcast signals with frequencies of at least about 2300 MHz.

6. The antenna of claim 1 wherein said radiating layer and said ground layer comprise metal or metal plating selected from the group consisting of Ag, Au, Cu, Ni, and Al.

7. The antenna of claim 1 wherein said dielectric layer comprises substances selected from the group consisting of Teflon, polytetrafluoroethylene, glass, ceramic, aluminum, a polymer, silica, and quartz.

8. The antenna of claim 1 wherein the dielectric layer of said second module comprises the same substance as the dielectric layer in said first module.

9. A module for a modular patch antenna system comprises a frame that attaches to or fits onto the periphery of a first module that comprises a first metal or metal-plated radiating layer, a second, middle dielectric layer, and a third metal or metal-plated ground layer, said frame comprising: a first metal or metal plated radiating layer, a second middle dielectric layer, and a third metal or metal plated ground layer, wherein the first metal or metal plated radiating layer in the second module abuts lies in substantially the same plane as the first metal or metal plated radiating layer in the first module, the second middle dielectric layer of the second module lies in substantially the same plane as the second middle dielectric layer of the first module, and the third metal or metal plated ground layer in the second module lies in substantially the same plane as the third metal or metal plated ground layer in said first module, and said frame has an inner periphery substantially the same as the outer periphery of the first module.

10. A modular patch antenna system comprising a first module and a second module, said first module comprising a first metal or metal-plated radiating layer, a second, middle dielectric layer, and a third metal or metal-plated ground layer, said second module comprising a frame that attaches to or fits onto the periphery of the first module, said frame comprising: a first metal or metal plated radiating layer, a second middle dielectric layer, and a third metal or metal plated ground layer, wherein the first metal or metal plated radiating layer in the second module lies in substantially the same plane as the first metal or metal plated radiating layer in the first module, the second middle dielectric layer of the second module lies in substantially the same plane as the second middle dielectric layer of the first module, and the third metal or metal plated ground layer in the second module lies in substantially the same plane as the third metal or metal plated ground layer in said first module, and said frame has an inner periphery substantially the same as the outer periphery of said first module.

11. The antenna of claim 10, wherein the dielectric layer of said second module lies in substantially the same plane as the dielectric layer of the first module, and has an inner periphery substantially the same as the outer periphery of the dielectric layer of said first module.

12. The antenna of claim 11, wherein all three layers of said second module have substantially the same height as the corresponding layers of said first module.

13. The antenna of claim 10, wherein said first module has a circularly polarized gain, at elevation angles of about 40° or more in the sky, in the range of about +5 to about +6 dBic, providing favorable satellite signal reception performance.

14. The antenna of claim 10, wherein said first and second modules are attached to one another, and said antenna has a circularly polarized gain at 0° elevation angle of at least about −2 dBic, providing favorable terrestrial signal reception performance.

15. The antenna of claim 10 linked to a receiver adapted to receive radio broadcast signals with frequencies of at least about 2300 MHz.

16. The antenna of claim 10, wherein said radiating layer and said ground layer comprise metal or metal plating selected from the group consisting of Ag, Au, Cu, Ni, and Al.

17. The antenna of claim 10, wherein said dielectric layer comprises substances selected from the group consisting of Teflon, polytetrafluoroethylene, glass, ceramic, aluminum, a polymer, silica, and quartz.

18. The antenna of claim 10, wherein the dielectric layer of said second module comprises the same substance as the dielectric layer in said first module.

* * * * *